United States Patent [19]

Uecker et al.

[11] Patent Number: 4,936,370

[45] Date of Patent: Jun. 26, 1990

[54] VERTICAL BLIND ASSEMBLY WITH AN ADJUSTABLE WIDTH

[75] Inventors: William F. Uecker, McHenry; Kenneth Hughes, Round Lake, both of Ill.

[73] Assignees: Chiang Por-Chu; Lin Chih-Jen, both of Taipei, Taiwan

[21] Appl. No.: 304,125

[22] Filed: Jan. 31, 1989

[51] Int. Cl.[5] ..... E06B 9/00

[52] U.S. Cl. ..... 160/168.1; 160/176.1; 160/900

[58] Field of Search ..... 160/168.1, 173, 176.1, 160/177, 178.1, 900, 107

[56] References Cited

U.S. PATENT DOCUMENTS

| | | | |
|---|---|---|---|
| 4,122,884 | 10/1978 | Salzmann | 160/178.1 X |
| 4,262,728 | 4/1981 | Debs | 160/176.1 X |
| 4,267,875 | 5/1981 | Koks | 160/176.1 |
| 4,293,021 | 10/1981 | Arena | 160/173 X |
| 4,425,956 | 1/1984 | Terlecke | 160/168.1 |
| 4,616,688 | 10/1986 | Agos | 160/176.1 |
| 4,628,981 | 12/1986 | Ciriaci et al. | 160/168.1 X |
| 4,732,202 | 3/1988 | Anderson | 160/178.1 X |
| 4,802,522 | 2/1989 | Anderson | 160/168.1 |
| 4,834,162 | 5/1989 | John | 160/168.1 |
| 4,834,163 | 5/1989 | Dickstein | 160/176.1 |

*Primary Examiner*—David M. Purol

*Attorney, Agent, or Firm*—Mathew R. P. Perrone, Jr.

[57] ABSTRACT

A vertical blind assembly, capable of having its mounting assembly or track easily shortened, has a generally square, generally U-shaped housing with a control end assembly situated on one end of the U-shaped housing and an idle end assembly situated at the other end of the housing. The idle end assembly is easily removed from the vertical blind assembly for the purpose of reducing the length of the U-shaped housing.

14 Claims, 4 Drawing Sheets

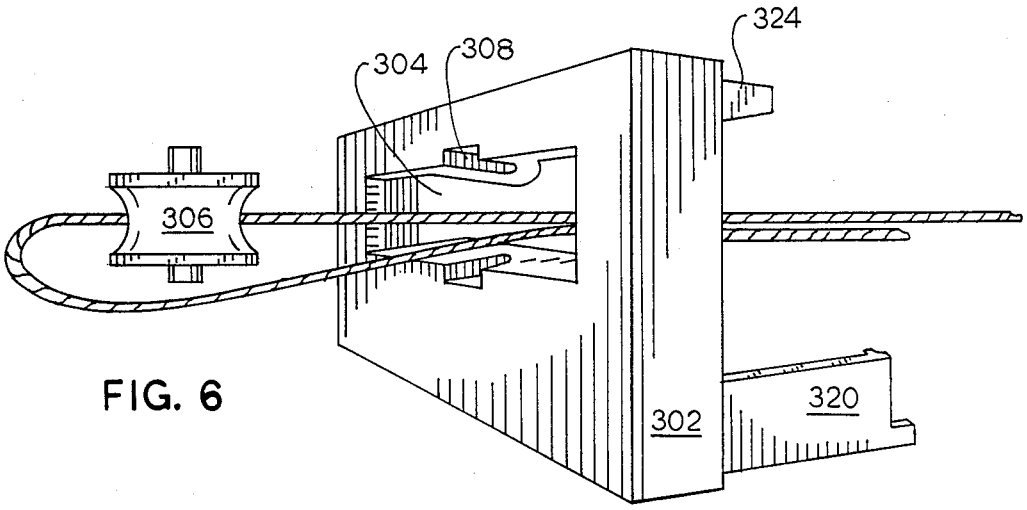
FIG. 6
FIG. 8
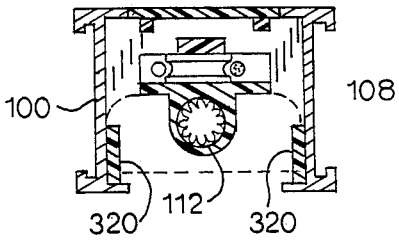
FIG. 7
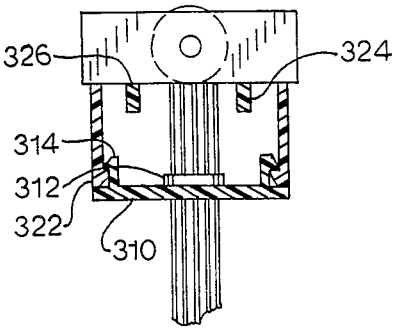
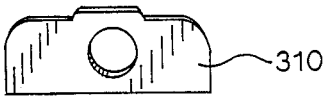
FIG. 9
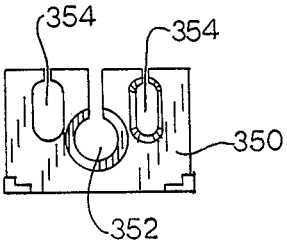
FIG. 10

VERTICAL BLIND ASSEMBLY WITH AN ADJUSTABLE WIDTH

BACKGROUND OF THE INVENTION

This invention relates to a vertical blind assembly and more particularly to a vertical blind assembly which may have the width of the mounting assembly or track housing, which is the control part of the vertical blind assembly, easily shortened as desired without major restructuring or complete disassembly.

It is well known that a covering for a window is desired. A particularly attractive and useful covering for a window is the vertical blind assembly. The vertical blind assembly generally includes a series of vertical slats or vanes (vane and slat being interchangeable terms) suspended from carriers, and has a control mechanism for rotating the individual slat carrier in unison and for moving the individual slat carrier in groups (generally one or two groups) from one side to another of the rack or housing in which they are mounted. There are many systems available for performing the functions of a vertical blind assembly. This is clearly indicated by U.S. Pat. No. 4,628,980 to James G. LeHouillier incorporated herein by reference.

There exist many control mechanisms for use with a vertical blind assembly. Three of the currently-known, principal types of the vertical blind assemblies are the American system, the Pantagraph System, and the accordian system. These systems cannot be easily adjusted in width or otherwise modified.

Variations on these assemblies include a blind system with two pinion gears and one traverse gear combined with a turning gear to provide for opening and closing of the blind, and the rotating of the individual slats (or carriers) of the blinds 180°. Another system has a spacer or pulling bar combined with a number of carriers.

All of the vertical blind assembly systems have in common a framework (the track) with an idle mechanism at one end, and a control mechanism at the other end of the framework. The idle end provides for a pulley system to open and close the blinds in cooperation with the control end. The framework also supports the slats between the idle end and the control end.

The control end is a gear end having gears for turning the blind slats through their procedures and for moving groups of blind slats together, to provide for a clear view through the window; or apart, to cover the window and provide a window covering. With the gearing system for the control end, the problems of shortening the vertical blind assembly are exacerbated.

If the slats of the vertical blind assembly are spaced apart to cover the window and are rotated to be substantially parallel to the window, the view through the window is blocked. If the slats of the vertical blind assembly are rotated to be substantially perpendicular to the window, a person is permitted to view through the window.

As the slats are rotated between the perpendicular and the parallel, the view through the window is adjusted as is the light flow. As the slats approach a position parallel to the window, the blocking of the view through the window increases, and the light flow through the blind assembly window decreases. As the slats approach a position perpendicular to the window, the blocking of the view through the window decreases and the light flow through the blind assembly increases.

If the slats of the vertical blind assembly are moved together and do not cover the window, rotation of the slats has no effect on the light transmission. Thus, rotation is unimportant to light transmission if the vertical blind assembly is open—that is, does not cover the window.

While the structures of the vertical blind assembly system are rather strong and indestructible, one quality lacking in the vertical blind assemblies is that there is no good way to make the track of a vertical blind assembly adjustable in terms of width to fit a certain width of window. In other words, a vertical blind assembly setup is bought in certain track widths.

Should a person desire to decrease the purchased vertical blind assembly width, major remanufacturing must be accomplished—if the decreased width can be achieved efficiently at all. This clearly takes the tailoring of vertical blind assembly out of the realm of the average do-it-yourself home owner or handyman, and restricts the use of vertical blind assemblies to the professional installer or remodeler.

It is, therefore, desirable to provide a vertical blind assembly suitable for tailoring by the home handyman so that the width of the blind can be adjusted as required. If this can be accomplished, the efficient and aesthetically attractive vertical blind assembly can be used in a more common fashion.

Typical methods of decreasing the width of the current vertical blind assemblies require complete disassembly of the blind. With the disassembly, much effort and great skill are required. If the skill needed to decrease the width of the vertical blind assembly can be brought within the skill of the average homeowner, the vertical blind assembly becomes more suitable for the homeowner to use. It is desirable, therefore, to reduce or eliminate the requirement for complete disassembly in order to decrease the width of the blind assembly.

Another problem associated with the track shortening aspect is the removal of the carrier which supports each slat of the vertical blind assembly. The carrier of the prior art is a unitary item place, which is removed from the track only with great difficulty, and requires complete disassembly of the entire vertical blind assembly. Yet the track shortening requires removal of some of the carriers.

A further problem with the carriers is found in the fact that the carriers, which carry the blind slats, vary in size corressponding to the size of the slats. It is presently necessary to carry many sizes of slat carriers to achieve the required results. If these carriers for the blinds can be modified, so that the carriers can have a simpler storage, a great advantage is achieved over the necessity of storing numerous differing batches of carriers. If it can be developed so that the idle and pulley assembly is adjusted for quick and easy cut resizing of the track to a lesser length may be accomplished without disassembling the track or removing a pull assembly situated therewithin.

It is also desirable to eliminate the need to store right and left embodiments for the carriers to make it simpler to store the assemblies, providing a great advantage in storage and other simplified supply problems in the manufacture thereof. If the carriers can be removed without disassembling the entire track, and without untying the pull cord knot, and further without removing the cord assembly within the frame work or track; great advantages are achieved in the quicker reduction of the width. Accordingly, these variations and modifications are highly desired.

SUMMARY OF THE INVENTION

Accordingly, among the many objects of this invention is to provide an adjustable vertical blind assembly, which may be simply decreased in width.

A further object of this invention is to provide an adjustable vertical blind assembly which may be decreased in width by a homeowner.

A still further object of this invention is to provide an adjustable vertical blind assembly which may be decreased in width while avoiding complete disassembly thereof.

Yet a further object of this invention is to provide an adjustable vertical blind assembly which has a simplified carrier structure.

Also an object of this invention is to provide an adjustable vertical blind assembly which has a simplified structure for changing the width of a track.

Another object of this invention is to provide an adjustable vertical blind assembly which has a simplified structure for inter-changing carriers from the left side to the right side.

Yet another object of this invention is to provide an adjustable vertical blind assembly which is simply operated.

Still another object of this invention is to provide a device, which is simply operated.

These and other objects (which other objects become clear by consideration of the specification, drawings and claims as a whole) of the invention are met by providing an adjustable vertical blind assembly having a two-piece idle end assembly and a two-piece carrier assembly to simplify a shortening procedure for a of the vertical blind assembly.

BRIEF DESCRIPTION OF THE DRAWINGS

FIG. 6 depicts a partially-exploded, perspective view of idle end assembly 300.

FIG. 7 depicts a top view of FIG. 6.

FIG. 8 depicts a reverse end view of FIG. 6.

FIG. 9 depicts a front view of idle holder 310.

FIG. 10 depicts a front plan view of pinion rod support 350.

Throughout the Figures of drawings where the same part appears in more than one Figure of the drawings, the same numeral is applied thereto.

DESCRIPTION OF THE PREFERRED EMBODIMENTS

A vertical blind assembly, capable of having its mounting assembly or track easily shortened, has a generally square, generally U-shaped housing with a control end assembly situated on one end of the U-shaped housing and an idle end assembly situated at the other end of the housing. The idle end assembly is easily removed from the vertical blind assembly for the purpose of reducing the length of the U-shaped housing. Between the idle end and the control end is a pinion rod, which connects the idle end to the control end. On the pinion rod is mounted a plurality of carriers for the purpose of holding slats of the vertical blind assembly. With the removal of the idle end, adjustments in the width of the vertical blind assembly may be made by the homeowner, with a shortening of the U-shaped housing and pinion rod and without complete disassembly thereof.

Figure 1:
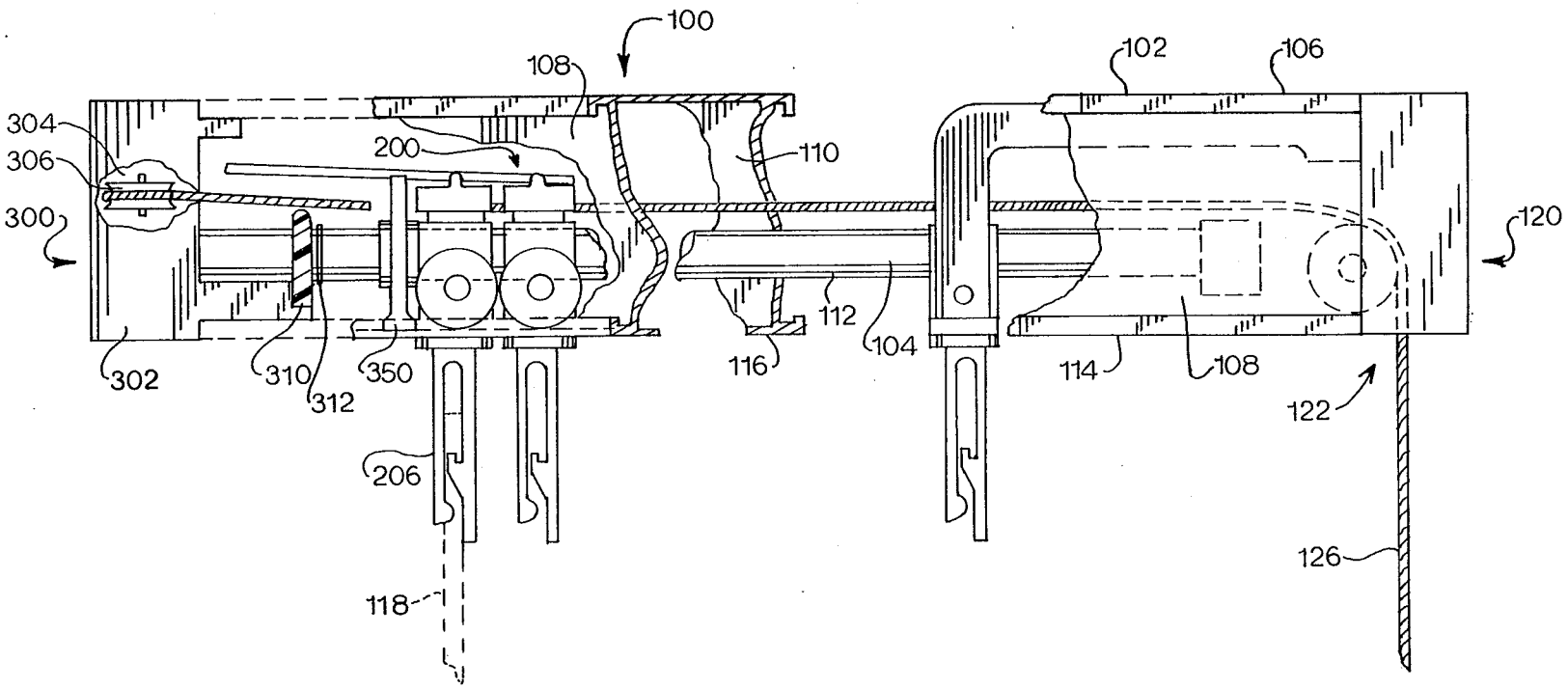
FIG. 1 depicts a side view of vertical blind assembly 100 partially cutaway appearance.

Referring now to FIG. 1, vertical blind assembly 100 is depicted in a side view with partial cutaway section. The vertical blind assembly 100 includes a control end assembly 120 secured to one end of a squared U-shaped housing 102. Secured to the other end of the squared U-shaped housing 102 is idle end 300. Mounted within squared U-shaped housing 102 and between idle end 300 and control end assembly 120 is a plurality of carrier assemblies 200.

Squared U-shaped housing 102 includes pinion rod 104 substantially located therein being of sufficient length to be secured at one end within control end assembly 120 and at the other end within idle end assembly 300. Squared U-shaped housing 102 has a U-base 106 with a first U-side 108 and a second U-side 110. The pinion rod 104 is fluted to provide ridges 112 to assist in the operation of carrier assemblies 200.

The idle end assembly 300 includes idle housing 302 with a housing slot 304 therein. Situated in the housing slot 304 is idle pulley 306, which receives the pull cord 126, which activates the closing or separation of the slats 118 as desired.

When the slats 118 are open, that is positioned so that the window (not shown) is not covered, pinion rod 104 is supported by pinion rod support 350, movably located centrally along the length of pinion rod 104. Pinion rod support 350 helps to avoid the formation of a sag in the pinion rod 104 when all of the slats 118 are situated at that end of the vertical blind assembly 100.

Figure 2:
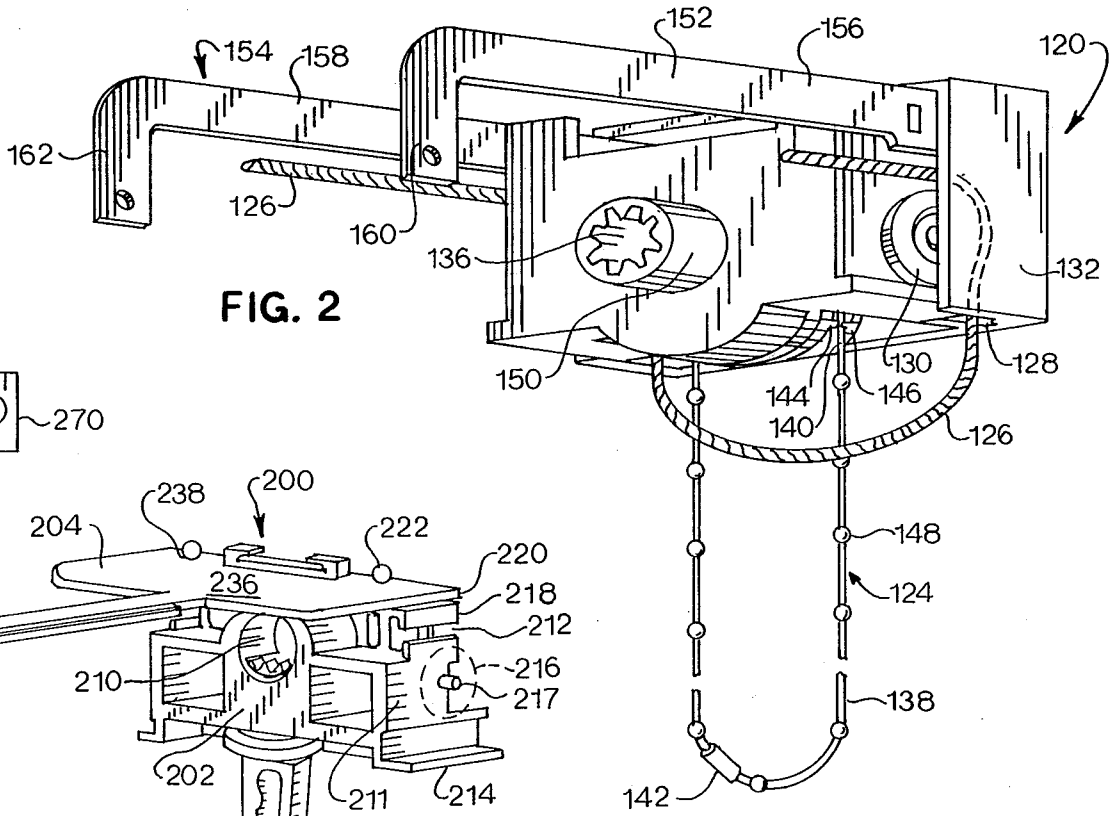
FIG. 2 depicts a perspective view of control end assembly 120 of vertical blind assembly 100.

Referring now to FIG. 2, the control end assembly 120 is depicted, which is inserted into housing 102, is depicted in perspective from the side. The control end assembly 120 includes a horizontal pull assembly 122 with a flat rotating assembly 124 therein. The pull cord 126 provides a method for separating the slats 118 of vertical blind assembly 100. A channel wheel 130 is situated on the side of control end assembly 120 and provides a guide mechanism and a support for moving pull cord 126. A control cap 132 covers the exterior and forms a part of control end assembly 120. The channel wheel 130 is situated within the control cap 132.

Figure 3:
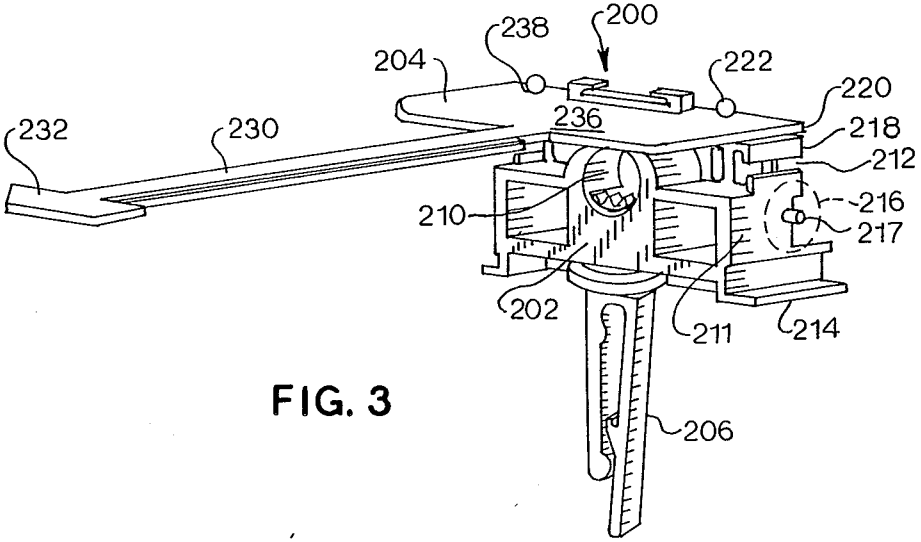
FIG. 3 depicts a perspective view of carrier assembly 200.

Referring now to FIG. 3, the carrier assembly 200 includes a base 202 to which a closure flange 204 and a carrier clip 206 are attached. The closure flange 204 is attached to a top portion of the base 202 by a snaplock mechanism, and the carrier clip 206 is rotatably secured to bottom of the closure base 202 and permits the slats 118 to move appropriately.

Within base 202 is a rod aperture 210, which permits the pinion rod 104 to pass therethrough. Pinion rod 104 receives all carrier assemblies 200 in vertical blind assembly 100 thereover. Formed in a sidewall 211 fashion on each side of base 202 is cord slot 212. It is cord slot 212 which permits pullcord 126 to be inserted into or removed from holder base 202. Below cord slot 212 is a lower housing ledge 214, which serves to stabilize carrier 200, in a slideable manner, within squared U-shaped housing 102 (shown in FIG. 1).

If it is desired to add or remove a carrier assembly 200 from vertical blind assembly 100, idle end assembly 300 is removed by removing clip 312. Pull cord 126 is removed through slot 212, and one or several carrier holder assemblies 200 may be removed from pinion rod 104. A carrier assembly 200 may be added by the reverse process. Pinion rod 104 and U-shaped housing 102 may be cut if required to decrease the width of vertical blind assembly 100. This tailoring of vertical blind assembly 100 is accomplished without removing the control end assembly 120.

Between lower housing ledge 214 and cord slot 212 is provided a pulley wheel 216 positioned on each side of the base 202. The pulley wheel 216 is mounted on a pin 217, which allows for rotation of the wheel 216 around a horizontal axis of the base 202. This pulley wheel 216, when the blind assembly 100 is assembled appropriately, rides along an inwardly directed lower flange 114, within the U-shaped housing 102, the flange 114 being received within a wheel slot 218 immediately above the lower housing ledge 214. The pulley wheel 216 is situated beneath a top mounting plate 220 fixed to the base 202.

Figure 13:
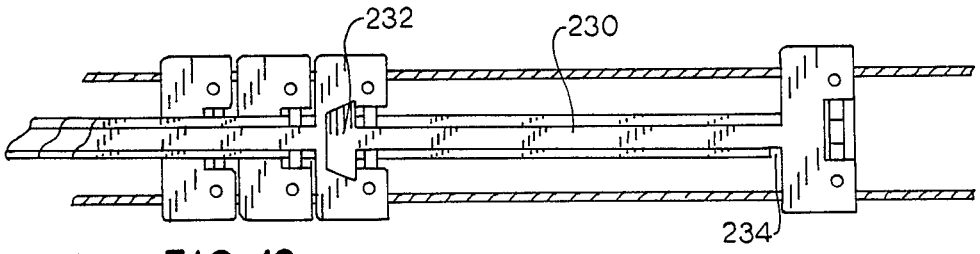
FIG. 13 depicts a top view of a plurality of carrier assemblies 200.

The mounting plate 220 of base 202 supports a blade holder 236. The blade holder 236 is a planar element and has apertures 238 in a top surface 239 thereof adapted to receive mounting turrets 222 extending upwardly from mounting plate 220 of housing 202. The blade holder 236 is mounted upon mounting plate 220. Extending horizontally from blade holder 236 is flange blade 230 having an expanded flange tip 232 at a distal end thereof and a blade notch 234 adjacent to blade holder 236 at a proximate end of flange blade 230. Blade notch 234 shown also in FIG. 13 is a slight indentation in flange blade 230 for permitting interconnection of the carrier assemblies 200. Flange tip 232 permits the drawing of the carrier assemblies 200 as the vertical blind assembly 100 is closed as described below.

Between mounting turrets 222 (more clearly shown in FIG. 13) on base 202 is blade grip 240. Blade grip 240 is basically a slotted member extending upwardly from blade holder 236. The blade grip 240 comprises a blade receiver 242 having a blade opening 244 of sufficient width to receive flange blade 230 at blade notch 234 and provides for a slideable relation of flange blade 230 within blade opening 244, while at the same time using receiver arms 246 to hold the blades in place.

Returning to the control end assembly 120, a pull chain 138 is provided, which engages within slots 140 of spiked pulley wheel 144, with the slots 140 being formed between adjacent protrusions 146 or spikes. Each bead 148 of the pull chain 138 is engaged within each one of the slots 140. The pulley 144 is sized and configured to receive beads 148, so that the pulley protrusions 146 grip the cord beads 148 (shown in FIG. 2) and permit the slats 118 to be rotated about a vertical axis. Assuming the slats 118 are separated to cover a window, as the slats 118 are rotated to be lengthwise parallel to a window, the view and light access through the blind assembly 100 are blocked. Still assuming the slats 118 are separated to cover a window, as the slats 118 are rotated to be lengthwise perpendicular to a window, the view and light access through the blind assembly 100 are permitted.

Figure 4:
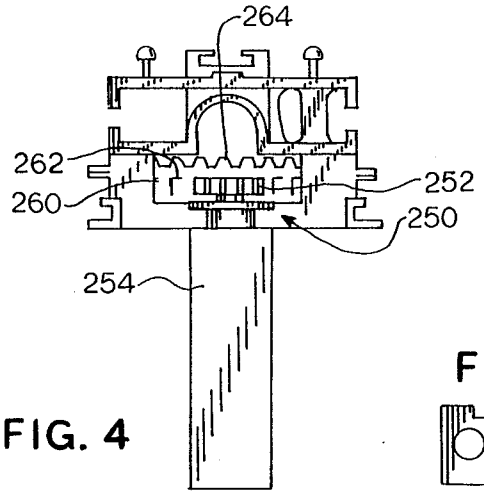
FIG. 4 depicts a reverse end view of FIG. 3.

Referring now to FIG. 4, the structure of carrier assembly 200 is shown. The carrier clip 206 is shown more clearly as having a gear end 250 with a circular gear 252 located thereon and a clip holder 254 at the opposing end which acts as a means for forming carrier clip 206 to hold a slat 118 in position. Within holder base 202 is a gear chamber 258 for receiving a slideable gear 260. The slideable gear 260 is basically a straight gear 260 having a series of notches 262 positioned to mesh with the teeth of circular gear 252 and move in relation to circular gear 252 in a slideable fashion back and forth. Straight gear incorporates a rod gear 264 on the top surface thereof, which is designed to mesh with the flutes 112 of pinion rod 104. Thus, the control end assembly 120 has a much simpler and more utilitarian design than that of the prior art.

Thus, when the slat pull chain 138 is pulled, spiked pulley wheel 144 rotates with fluted rod 104 secured therein. In so rotating, straight gear 260 is moved thereby moving rod gear 264, which results in the moving of the straight notches 262 which in turn results in the moving of circular gear 252. As circular gear 252 moves, the slats 118 rotate about a vertical axis. In this fashion, a venetian-blind effect of moving the vanes 118 rotationally back and forth is achieved in an expedient fashion.

Figure 5:
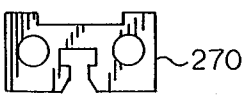
FIG. 5 depicts a front view of rope clip 270.

As clearly set forth, pinion rod 104 is held in place by the control rod receiver 136. Receiver rod apertures 148 receive the pinion rod 104 in a female male relationship. Because the control rod receiver 136 is fixed, but rotatable, the pinion rod 104 rotates about its horizontal axis and provides the means for rotating the slats 118 about the vertical axis thereof. Pull cord 126 is held in place in one of the carrier assemblies 200 by the rope clip 270 (also shown in FIG. 5) which fits within the flange mount channel 128.

Referring now to FIG. 6, FIG. 7, and FIG. 8, idle end assembly 300 is depicted. Idle end assembly 300 includes idle housing 302. Within the idle housing 302 is housing slot 304 which receives idle pulley 306 therein. Idle pulley 306 forms a return mechanism for pull cord 126. Idle pulley 306 is a standard pulley mounted on an axle fitted into the idle pulley slots 308 within the housing slots 304. The idle housing 302 of idle end 300 is connected to idle end holder 310 by a snap fit mechanism. The idle end holder 310 is held in place by lock mechanism 314 which is slideable mounted on pinion rod 104 and clipped onto pinion rod 104 — adjacent to idle end holder 310, and between idle housing 302 and idle end holder 310.

Holder lock 314 of idle end holder 310 and idle housing 302 combine in a snap lock fashion to thereby lock idle end assembly 300 on U-shaped housing 102. In this fashion, the idle end assembly 300 is locked in place. The idle end assembly further includes a housing arm 320 and a housing clip 322. The housing clip 322 mates with the holder lock 314 in a snap together fashion and holds the idle housing 302 on pinion rod 104.

Protruding from a lower portion of idle end assembly 300 is a pair of housing arms 320. Housing arms 320 are located, when idle end assembly 300 is inserted in U-shaped housing 102, at a lower portion thereof opposite U-base 106. Adjacent U-base 106 is first U-support 324 and second U-support 326 as protrusions off of idle housing 302 into contact with holder lock 314. In this fashion, idle end assembly 300 is supported within U-shaped housing 102.

Referring now to FIG. 10, pinion rod holder 350 provides support for pinion rod 104 shown in FIG. 1, when the slats 118 do not cover the window. Such weight concentrated on an area of the pinion rod 104 may bend the pinion rod 104 and interfere with the functioning of the blind assembly 100. Pinion rod holder 350 has a pinion rod slot 352 for receiving pinion rod 104 and a cord slot 354 on either side thereof for receiving the cord 126. Pinion rod holder 350 is slidably mounted over pinion rod 104 and onto U-base 106. Easement of the pinion rod holder 350 with U-base 106 provides support for the pinion rod 104.

Figure 11:
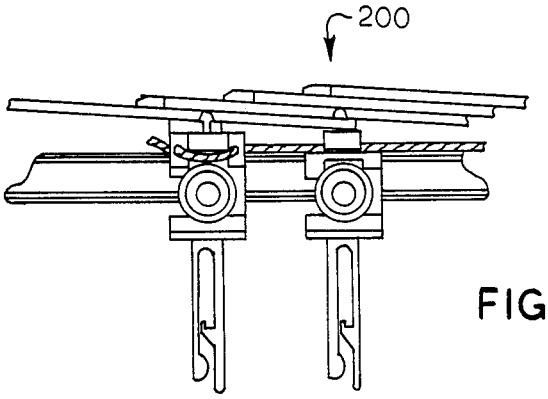
FIG. 11 depicts a side view of a plurality of carrier assemblies 200.
Figure 12:
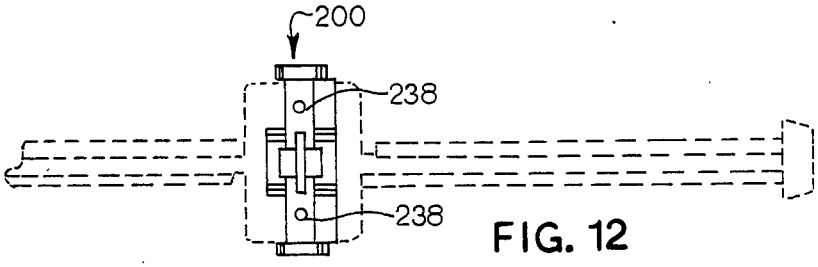
FIG. 12 depicts a top view of carrier assembly 200.
Figure 14:
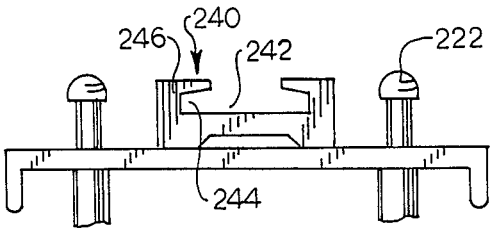
FIG. 14 depicts a front view of a plurality of carrier assemblies 200.

Referring now to FIG. 11, FIG. 12 and FIG. 13 the arrangement of the carrier assembly 200 is depicted. Specifically, the flange blades 230 are shown as fitting into blade gripper 240 (shown in FIG. 14) and the flange tip 232 is shown as being fixed against the holder aperture 238 in order to separate the slats 118 and close the vertical blind assembly 100.

It is the mounting turrets 222 of housing 202 which permit blade 230 to be reversed without having separate carrier assemblies 200 for left and right, as required by the prior art. In other words, blade flange 236 can just be removed and reversed to accomplish that for which the prior art requires two different assemblies.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinarY skill in this particular art. Such modifications are clearly covered by this disclosure.

What is claimed and sought to be protected by letters patent by the United States is:

We claim:

1. A vertical blind assembly, having an easily reduced width, wherein:

a. said vertical blind assembly has a square, U-shaped housing with a control end assembly secured to a first end of said U-shaped housing and an idle end assembly removably secured to a second end of said U-shaped housing;

b. said first end is oppositely disposed from said second end;

c. a pinion rod is operably mounted between said idle end and said control end assembly;

d. at least one carrier assembly is slidably mounted on said pinion rod;

e. said at least one carrier assembly is removably mounted on said pinion rod with said idle removed and said control end assembly secured to said U-shaped housing;

f. said at least one carrier assembly includes a closure base;

g. a closure flange and a carrier clip are attached to said closure base;

h. said closure base includes a top mounting plate;

i. said top mounting plate receives said closure flange;

j. said closure flange includes a blade holder and a flange blade extending horizontally from said blade holder; and k. said blade holder is a planar element snap-fitted to said mounting plate.

2. The vertical blind assembly of claim 1 wherein:

a. said pinion rod includes an operating means for said at least one carrier assembly;

b. a slat is removably secured to said at least one carrier assembly;

c. said operating means rotates said slat about a vertical axis of said slat; and d. said pinion rod connects said idle end assembly and said control end assembly.

3. The vertical blind assembly of claim 2 wherein:

a. said pinion rod is fluted to cooperate with said operating means;

b. said pinion rod is substantially centrally located within said U-shaped housing;

c. said idle end assembly includes an idle housing with a housing slot; and d. an idle pulley is rotatably situated in the housing slot.

4. The vertical blind assembly of claim 3 wherein:

a. said pinion rod is supported by a pinion rod support slidably mounted on said pinion rod;

b. said control end assembly includes a horizontal pull assembly therein;

c. said horizontal pull assembly includes a flat rotating assembly;

d. a pull cord connects said control end assembly and said idle end assembly; and e. said pull cord provides a means for separating a first member of said at least one slat from a second member of said at least one slat.

5. The vertical blind assembly of claim 4 wherein:

a. said control end assembly further includes a guide mechanism and a support means for said pull cord; and b. said control end assembly further includes a control cap to cover said control end.

6. The vertical blind assembly of claim 5 wherein:

a. said blade holder has a pair of apertures therein;

b. said top mounting plate includes a pair of mounting turrets extending upwardly;

c. said pair of apertures are adapted to receive said pair of mounting turrets, whereby said carrier assembly achieves reversibility and flexibility;

d. said carrier clip is rotatably secured to a bottom portion of said closure base and receives said at least one slat; and e. a rod aperture in said closure base receives said pinion rod in a slidable fashion so that said at least one carrier assembly is slidably mounted thereon.

7. The vertical blind assembly of claim 6 wherein:

a. said closure base includes a first cord slot on a first side of said closure base and a second cord slot oppositely disposed from said first cord slot on a second side of said closure base;

b. said first cord slot and said second cord slot receive said pull cord;

c. a first lower housing ledge on said closure base supports said closure base within said U-shaped housing;

d. said first lower housing ledge on said closure base is between said first cord slot and said carrier clip;

e. a first pulley wheel is rotatably mounted on said closure base between said first cord slot and said carrier clip;
f. said first pulley wheel rides along a first inwardly directed lower flange within said U-shaped housing;
g. a second lower housing ledge on said closure base supports said closure base within said U-shaped housing;
h. said second lower housing ledge on said closure base is between said second cord slot and said carrier clip;
i. a second pulley wheel is rotatably mounted on said closure base between said second cord slot and said carrier clip; and
j. said second pulley wheel rides along a second inwardly directed lower flange within said U-shaped housing.

8. The vertical blind assembly of claim 7 wherein:
a. said flange blade includes an expanded flange tip at a distal end thereof and a blade notch adjacent to said blade holder at a proximate end of said flange blade; and
b. said blade notch is a slight indentation in flange blade to permit interconnection of said first member of said carrier assembly with said second member of said carrier assembly.

9. The vertical blind assembly of claim 8 wherein:
a. a blade grip is situated between said mounting turrets to receive said flange blade;
b. said blade grip receives said flange blade;
c. said blade notch fits through said blade grip; and
d. said expanded flange tip is removably held by said blade grip.

10. The vertical blind assembly of claim 9 wherein:
a. said control end assembly includes a spiked pulley wheel having at least one slot to receive at least one bead; and
b. said at least one bead is secured to a pull chain.

11. The vertical blind assembly of claim 10 wherein:
a. said carrier assembly includes said carrier clip;
b. said carrier clip includes a gear end and a clip holder oppositely disposed from said gear end;
c. said gear end includes a circular gear located thereon; and
d. said clip holder holds one of said at least one slat.

12. The vertical blind assembly of claim 11 wherein:
a. said carrier assembly includes a holder base;
b. said holder base includes gear chamber;
c. said gear chamber contains a slidable gear;
d. said slidable gear has notches positioned to mesh with said circular gear and move in relation to said circular gear in a slidable fashion back and forth;
e. said slidable gear incorporstes a rod gear on a top surface thereof; and
f. said rod gear meshes with said pinion rod, so that rotation of said pinion rod moves said slidable gear and rotates said slats.

13. The vertical blind assembly of claim 12 wherein:
a. said idle end housing includes an idle end holder with a snap fit mechanism to hold idle end housing within said idle housing;
b. a removable locking mechanism on said pinion rod within said U-shaped housing;
c. said idle end housing includes a housing arm adjacent a base of said U-shaped housing; and
d. a pinion rod support is slidably mounted on said pinion rod and in contact with said U-shaped housing.

14. The vertical blind assembly of claim 13 wherein:
a. said carrier assembly has a a blade gripper to receive said flange blade; and
b. said flange blade includes an expanded flange tip at a distal end thereof to cooperate with said blade gripper and a blade notch adjacent to said blade holder at a proximate end of said flange blade; and
b. said mounting turrets permit said blade to be reversed.

* * * * *